US008308547B2

(12) United States Patent
Walker et al.

(10) Patent No.: US 8,308,547 B2
(45) Date of Patent: Nov. 13, 2012

(54) SELECTION OF MULTIPLE ROULETTE WHEELS

(75) Inventors: Jay S. Walker, Ridgefield, CT (US); Russell P. Sammon, San Francisco, CA (US); Daniel E. Tedesco, Huntington, CT (US); Robert C. Tedesco, Fairfield, CT (US)

(73) Assignee: IGT, Reno, NV (US)

( * ) Notice: Subject to any disclaimer, the term of this patent is extended or adjusted under 35 U.S.C. 154(b) by 525 days.

(21) Appl. No.: 12/517,661

(22) PCT Filed: Dec. 4, 2007

(86) PCT No.: PCT/US2007/024801

§ 371 (c)(1),
(2), (4) Date: Dec. 1, 2009

(87) PCT Pub. No.: WO2008/070055

PCT Pub. Date: Jun. 12, 2008

(65) Prior Publication Data

US 2010/0120487 A1 May 13, 2010

Related U.S. Application Data

(60) Provisional application No. 60/868,470, filed on Dec. 4, 2006, provisional application No. 60/890,366, filed on Feb. 16, 2007.

(51) Int. Cl.
*A63F 9/24* (2006.01)

(52) U.S. Cl. ..... 463/17; 463/18

(58) Field of Classification Search ..... 463/17, 463/18

See application file for complete search history.

(56) References Cited

U.S. PATENT DOCUMENTS

| | | | |
|---|---|---|---|
| 4,652,998 | A | 3/1987 | Koza et al. |
| 5,722,891 | A | 3/1998 | Inoue |
| 5,820,459 | A | 10/1998 | Acres et al. |
| 6,098,985 | A | 8/2000 | Moody |

(Continued)

FOREIGN PATENT DOCUMENTS

AU 2004248858 A1 12/2004

(Continued)

OTHER PUBLICATIONS e-FX Roulette Display, [online] [printed on Nov. 8, 2006]. Retrieved from the Internet at <URL: file:// C:\DOCUME~1\rys\LOCALS~1\Temp\S4M2B8E0.htm>.

(Continued)

*Primary Examiner* — Pierre E Elisca
(74) *Attorney, Agent, or Firm* — Neal, Gerber & Eisenberg LLP

(57) ABSTRACT

A roulette game allows players to place wagers across multiple roulette wheels. The player designates the amount of the wager, the particular outcomes on which the wager is contingent, and how many tables are covered by the wager. A control system automatically selects one or more tables across which the wager is based. The selection may be based on location of the player relative to the tables, impending outcomes from the tables, or other criteria as desired.

47 Claims, 14 Drawing Sheets

BET RESOLUTION DATABASE FOR PLAYER-5890245, LARRY LOSER

| PORTION OF BET | NUMBER SELECTED BY PLAYER-5890245, LARRY LOSER | WHEEL THAT GENERATED OUTCOME | OUTCOME | OUTCOME MATCHES PLAYER SELECTION |
|---|---|---|---|---|
| MAIN WHEEL | 21-RED | WHEEL-6 | 21-RED | YES |
| SECOND WHEEL | 25-RED | WHEEL-7 | 25-RED | YES |
| THIRD WHEEL | 11-BLACK | WHEEL-1 | 00-GREEN | NO |
| FOURTH WHEEL | 29-BLACK | WHEEL-3 | 13-BLACK | NO |

U.S. PATENT DOCUMENTS

| | | | | |
|---|---|---|---|---|
| 6,565,436 | B1 | 5/2003 | Baerlocher | |
| 6,568,680 | B1 | 5/2003 | Moody et al. | |
| 6,659,866 | B2 * | 12/2003 | Frost et al. | 463/17 |
| 6,702,667 | B2 | 3/2004 | Mattice et al. | |
| 6,722,858 | B2 | 4/2004 | Yoshimura et al. | |
| 6,733,385 | B1 | 5/2004 | Enzminger et al. | |
| 6,890,255 | B2 | 5/2005 | Jarvis et al. | |
| 7,160,188 | B2 | 1/2007 | Kaminkow et al. | |
| 7,306,520 | B2 | 12/2007 | Kaminkow et al. | |
| 7,329,187 | B1 | 2/2008 | Holch et al. | |
| 7,425,177 | B2 | 9/2008 | Rodgers et al. | |
| 7,594,851 | B2 | 9/2009 | Falconer | |
| 2004/0166942 | A1 | 8/2004 | Muir | |
| 2008/0128986 | A1 * | 6/2008 | Morris et al. | 273/142 E |
| 2008/0211180 | A1 * | 9/2008 | Lutnick et al. | 273/142 C |
| 2008/0258383 | A1 * | 10/2008 | Sorge | 273/142 E |
| 2009/0104963 | A1 * | 4/2009 | Burman et al. | 463/18 |
| 2012/0094734 | A1 * | 4/2012 | Fisher et al. | 463/17 |

FOREIGN PATENT DOCUMENTS

| | | | |
|---|---|---|---|
| GB | 2413092 | A | 12/2004 |

OTHER PUBLICATIONS

Fully Automated Wheel, [online] [printed on Nov. 1, 2006]. Retrieved from the Internet at <URL: http://www.nrcgamingsystems.com/our_products.asp>.

LuminAR (Illuminated Roulette), [online] [printed on Oct. 31, 2006]. Retrieved from the Internet at <URL:http://www.tcsjohnhuxley.com.au/products/roulette/luminar.htm>.

Mark VII Wheel, [online] [printed on Oct. 31, 2006]. Retrieved from the Internet at <URL:http://www.tcsjohnhuxley.com.au/products/roulette/roulettewheels/markvii.htm>.

Mauritian Roulette from Ultimate Success Gaming, [online] [printed on Oct. 31, 2006]. Retrieved from the Internet at <URL:http://www.gamingfloor.com/features/usg/MagicR.htm>.

Roulette Wheel Analysis, [online] [printed on Oct. 31, 2006]. Retrieved from the Internet at <URL:http://www.tcsjohnhuxley.com.au/products/roulette/roulettewheelanalysis.htm>.

Roulette Wheels catalog, published by Gaming Partners International SAS, available prior to Nov. 10, 2006.

* cited by examiner

| SPIN ID | TIME OF RESOLUTION | ROULETTE WHEEL ID | OUTCOME |
|---|---|---|---|
| SPIN-3-570134 | 2007-02-14 7:12:34 PM | WHEEL-3 | 16-RED |
| SPIN-2-45525 | 2007-02-14 7:12:51 PM | WHEEL-2 | 6-BLACK |
| SPIN-6-890123 | 2007-02-14 7:12:53 PM | WHEEL-6 | 21-RED |
| SPIN-7-12345 | 2007-02-14 7:13:35 PM | WHEEL-7 | 25-RED |
| SPIN-1-48701 | 2007-02-14 7:13:41 PM | WHEEL-1 | 00-GREEN |
| SPIN-3-570135 | 2007-02-14 7:14:10 PM | WHEEL-3 | 13-BLACK |
| SPIN-6-890124 | 2007-02-14 7:14:32 PM | WHEEL-6 | 7-RED |
| SPIN-2-45526 | 2007-02-14 7:14:58 PM | WHEEL-2 | 17-BLACK |

FIG. 9A

| ROULETTE WHEEL ID | RESOLUTION TIME OF PREVIOUS SPIN | CURRENT STATUS | ANTICIPATED RESOLUTION TIME OF NEXT SPIN |
|---|---|---|---|
| WHEEL-1 | 2007-02-14 7:13:41 PM | WHEEL SPINNING, NO MORE BETS | 2007-02-14 7:15:22 PM |
| WHEEL-2 | 2007-02-14 7:14:58 PM | PAYING WINNERS | 2007-02-14 7:16:48 PM |
| WHEEL-3 | 2007-02-14 7:14:10 PM | ACCEPTING BETS | 2007-02-14 7:15:59 PM |
| WHEEL-4 | NOT IN SERVICE | NOT IN SERVICE | NOT IN SERVICE |
| WHEEL-5 | 2007-02-14 7:14:01 PM | ACCEPTING BETS | 2007-02-14 7:15:48 PM |
| WHEEL-6 | 2007-02-14 7:14:32 PM | ACCEPTING BETS | 2007-02-14 7:16:10 PM |
| WHEEL-7 | 2007-02-14 7:13:35 PM | WHEEL SPINNING, NO MORE BETS | 2007-02-14 7:15:15 PM |
| WHEEL-8 | NOT IN SERVICE | NOT IN SERVICE | NOT IN SERVICE |

FIG. 9B

| SESSION INFO | |
|---|---|
| PLAYER ID | PLAYER-12370983 |
| PLAYER NAME | LUCKY LUKE |
| CREDIT BALANCE | $154.00 |
| MAIN WHEEL SELECTED | WHEEL-2 |
| DEFAULT BET SELECTION FOR SECOND WHEEL | 21-RED |
| DEFAULT BET SELECTION FOR THIRD WHEEL | 25-RED |
| DEFAULT BET SELECTION FOR FOURTH WHEEL | 00-GREEN |

FIG. 10A

| BET INFO | |
|---|---|
| BET AMOUNT | $1 |
| BET SELECTION FOR MAIN WHEEL | 6-BLACK |
| BET SELECTION FOR SECOND WHEEL | 21-RED |
| BET SELECTION FOR THIRD WHEEL | 25-RED |
| BET SELECTION FOR FOURTH WHEEL | 00-GREEN |

FIG. 10B

BET RESOLUTION DATABASE FOR PLAYER-12370983, LUCKY LUKE

| PORTION OF BET | NUMBER SELECTED BY PLAYER-12370983, LUCKY LUKE | WHEEL THAT GENERATED OUTCOME | OUTCOME | OUTCOME MATCHES PLAYER SELECTION |
|---|---|---|---|---|
| MAIN WHEEL | 6-BLACK | WHEEL-2 | 6-BLACK | YES |
| SECOND WHEEL | 21-RED | WHEEL-6 | 21-RED | YES |
| THIRD WHEEL | 25-RED | WHEEL-7 | 25-RED | YES |
| FOURTH WHEEL | 00-GREEN | WHEEL-1 | 00-GREEN | YES |

FIG. 11

| SESSION INFO | |
|---|---|
| PLAYER ID | PLAYER-5890245 |
| PLAYER NAME | LARRY LOSER |
| CREDIT BALANCE | $18.00 |
| MAIN WHEEL SELECTED | WHEEL-6 |
| DEFAULT BET SELECTION FOR SECOND WHEEL | 25-RED |
| DEFAULT BET SELECTION FOR THIRD WHEEL | 11-BLACK |
| DEFAULT BET SELECTION FOR FOURTH WHEEL | 29-BLACK |

FIG. 12A

| BET INFO | |
|---|---|
| BET AMOUNT | $2 |
| BET SELECTION FOR MAIN WHEEL | 21-RED |
| BET SELECTION FOR SECOND WHEEL | 25-RED |
| BET SELECTION FOR THIRD WHEEL | 11-BLACK |
| BET SELECTION FOR FOURTH WHEEL | 29-BLACK |

FIG. 12B

BET RESOLUTION DATABASE FOR PLAYER-5890245, LARRY LOSER

| PORTION OF BET | NUMBER SELECTED BY PLAYER-5890245, LARRY LOSER | WHEEL THAT GENERATED OUTCOME | OUTCOME | OUTCOME MATCHES PLAYER SELECTION |
|---|---|---|---|---|
| MAIN WHEEL | 21-RED | WHEEL-6 | 21-RED | YES |
| SECOND WHEEL | 25-RED | WHEEL-7 | 25-RED | YES |
| THIRD WHEEL | 11-BLACK | WHEEL-1 | 00-GREEN | NO |
| FOURTH WHEEL | 29-BLACK | WHEEL-3 | 13-BLACK | NO |

FIG. 13

SELECTION OF MULTIPLE ROULETTE WHEELS

CROSS-REFERENCE TO RELATED APPLICATIONS

The present application claims priority to and the benefit of International Application No. PCT/US/07/24801, filed Dec. 4, 2007 and entitled "SELECTION OF MULTIPLE ROULETTE WHEELS" which claims priority to U.S. Provisional Patent Application No. 60/890,366, filed Feb. 16, 2007 and entitled "OFFERING A JACKPOT BASED ON MULTIPLE ROULETTE OUTCOMES" and U.S. Provisional Patent Application No. 60/868,470, filed Dec. 4, 2006 and entitled "METHODS FOR EMPLOYING HANDHELD ELECTRONIC DEVICES TO ENHANCE PLAY OF TABLE GAMES".

The present application is also related to U.S. patent application Ser. No. 11/816,298, filed Aug. 15, 2007 and entitled "CUSTOMIZABLE DISPLAY OF ROULETTE BETTING LAYOUT".

The entirety of each of the above applications is incorporated by reference herein for all purposes.

FIELD OF THE INVENTION

The present disclosure is directed to a system that facilitates wagers being placed across a plurality of roulette wheels.

BRIEF DESCRIPTION OF THE DRAWINGS

FIGS. 9A & 9B illustrate an exemplary spin tracking database for use with some embodiments of the present disclosure.

FIGS. 10A-13 illustrate database entries used to in selecting wheels for use in a wager according to at least some embodiments of the present disclosure.

DETAILED DESCRIPTION OF THE INVENTION

Figure 5:
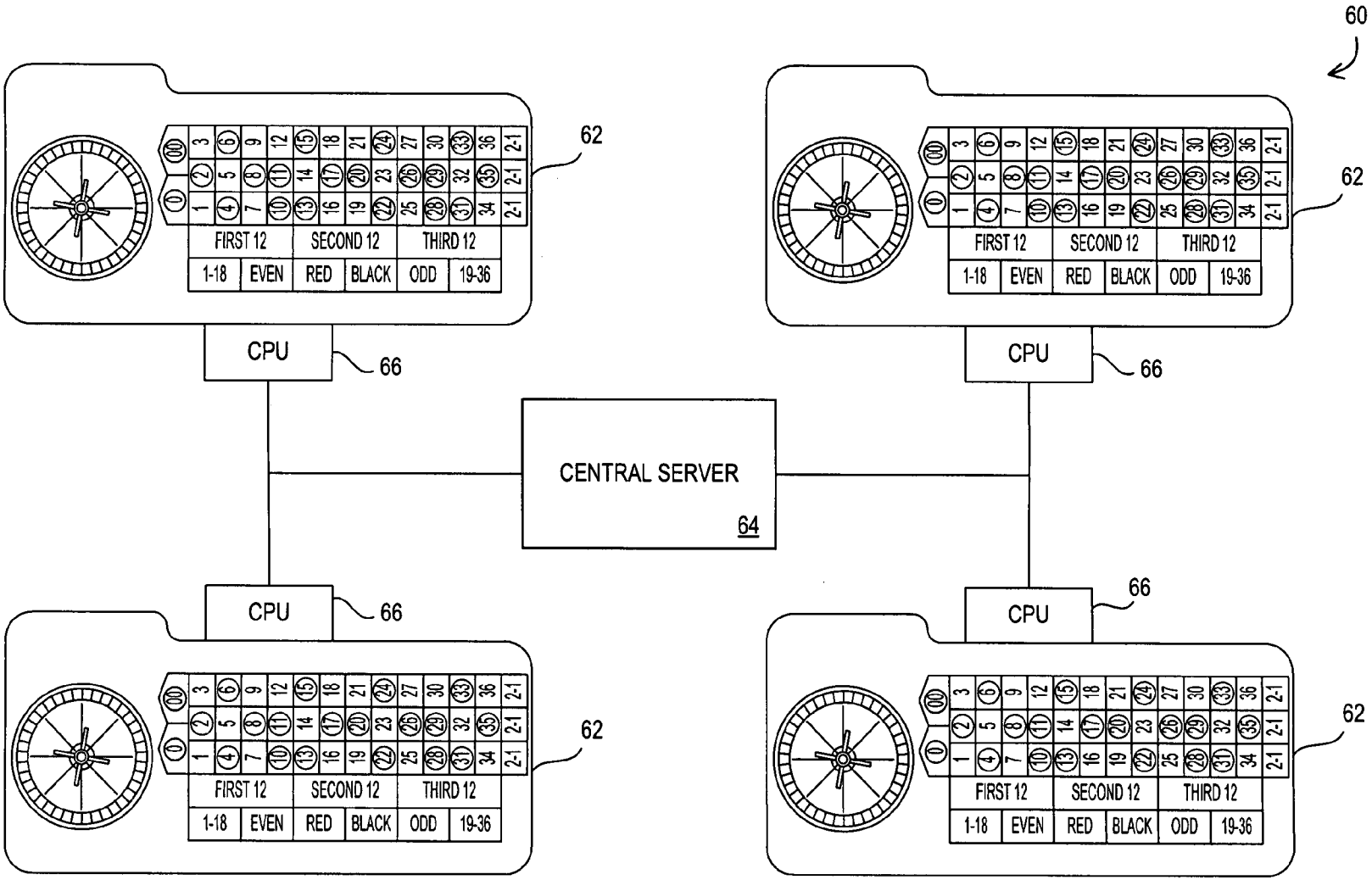
FIG. 5 illustrates a system of roulette tables suitable for use some embodiments of the present disclosure.

A brief overview of conventional roulette tables is provided with the discussion of the present disclosure beginning with reference to FIG. 5 below. An initial note about terminology is appropriate. It should be understood that features such as a "roulette wheel" and "balls" need not be conventional physical elements. Simulated or virtual wheels and balls are also to be included. Thus, the generic term used herein is "roulette wheel" or balls. Where the disclosure needs to differentiate, the appropriate adjective "physical" or "virtual" is used.

Further, the roulette wheel need not be an exact replica of a traditional (American or European (both explained below)) roulette wheel. For example, the numbers and/or colors on the wheel could be arranged in a different manner; more or fewer numbers could be included, and/or the numbers could be replaced by symbols (e.g., fruit). Similarly, "spinning" of a wheel can cover any arrangement (e.g., a graphical animation) where a number on a roulette wheel is selected in what appears to be a random manner. That said, the examples discussed below and illustrated in the drawings generally use an American style roulette wheel for ease in understanding.

Figure 1:
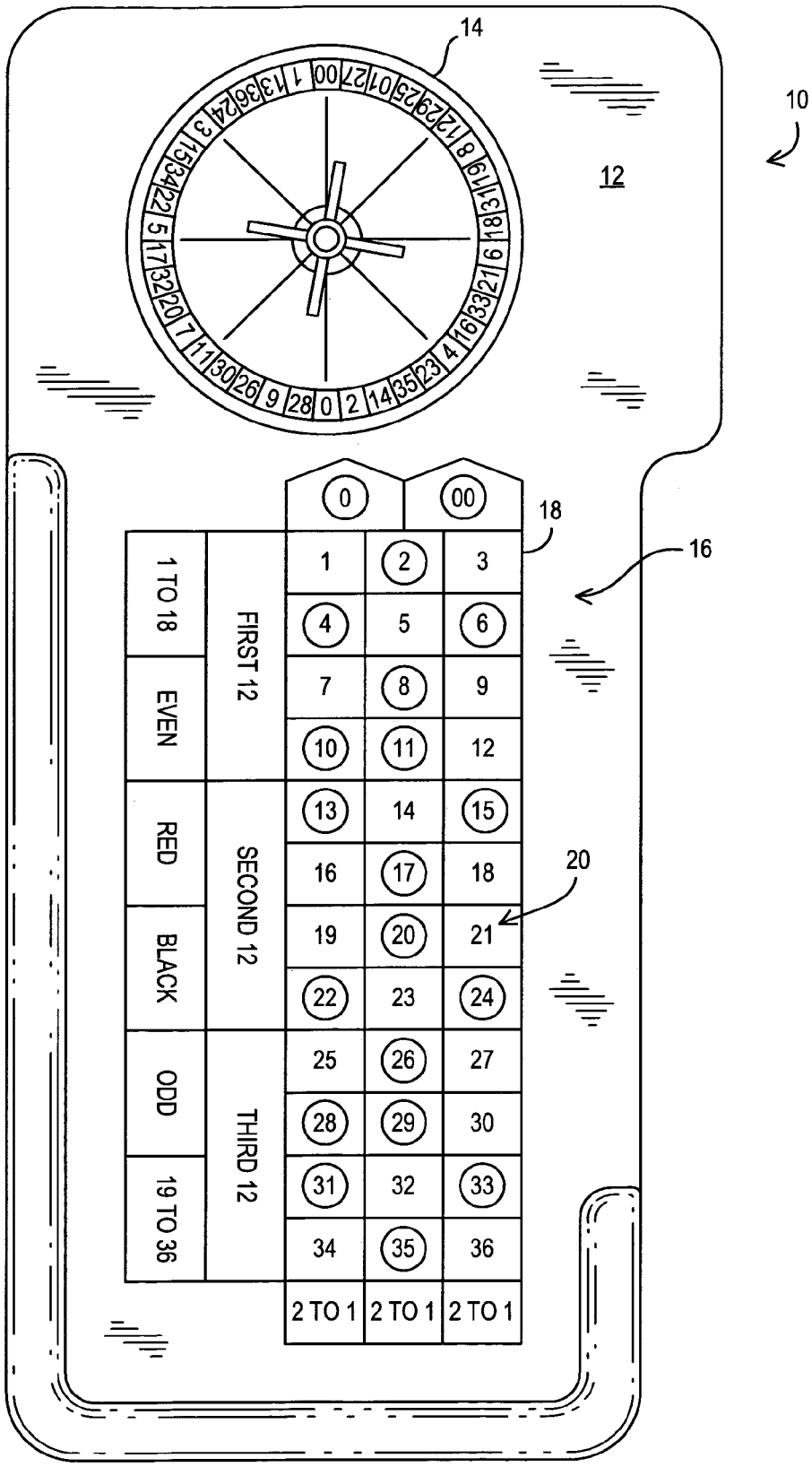
FIG 1 PRIOR ART
FIGS. 1-4 illustrate conventional roulette tables.

FIG. 1 illustrates a plan view of a conventional physical roulette table 10. The roulette table 10 may have a planar surface 12 on which a roulette wheel 14 is positioned in such a manner that the roulette wheel 14 may spin freely as is well understood. A betting field 16 is disposed opposite the roulette wheel 14 and includes indicia 18 that delimit individual bet options 20.

In practice, players purchase chips from the croupier and place bets by positioning their chips relative to the indicia 18 such that a bet option 20 is selected. The croupier spins the roulette wheel 14 and introduces a ball thereinto. The ball moves around the wheel 14 in a direction opposite the rotation of the wheel 14. Friction slows the ball until it falls into a labeled cup on the wheel 14 as is well understood. The croupier collects the chips from the losing wagers and dispenses chips for the winning wagers. The process then repeats. Some tables have a historical outcomes display that lists outcomes from previous spins. For example, outcomes for the last ten spins may be displayed. While each spin is independent of every other spin, some players may use this historical outcome listing to assist them in guessing which numbers are "due" or which numbers are "hot".

As briefly mentioned above, there are two generally recognized styles of roulette wheels 14, namely U.S. and European. The difference between the two styles is that the U.S. style roulette wheel includes the numbers zero through thirty-six and a double zero. In contrast, the European style roulette wheel includes just numbers zero through thirty-six. Roulette wheel 14, as illustrated, is a U.S. style roulette wheel and the present disclosure focuses on the U.S. style of a roulette wheel, but the teachings set forth herein are generally applicable to a European wheel. Note that the number placement on the wheel differs between the U.S. style and the European style, such that while some numbers may be next to each other on a U.S. wheel, the numbers may not be next to each other on a European wheel.

Conventional betting options presented on the table 10 include the numbers individually (a straight or straight up bet), even, odd, red, black, low (numbers one through eighteen), high (numbers nineteen through thirty-six), first twelve (numbers one through twelve), second twelve (numbers thirteen through twenty-four), third twelve (numbers twenty-five through thirty-six), first column (numbers one, four, seven, ten, thirteen, sixteen, nineteen, twenty-two, twenty-five, twenty-eight, thirty-one, and thirty-four), second column (numbers two, five, eight, eleven, fourteen, seventeen, twenty, twenty-three, twenty-six, twenty-nine, thirty-two, and thirty-five), and third column (numbers three, six, nine, twelve, fifteen, eighteen, twenty-one, twenty-four, twenty-seven, thirty, thirty-three, and thirty-six). Each of these bet options has explicit indicia 18 on the table 10.

There are other conventional wagers that do not have specific indicia, but whose import is known to roulette players. A split bet is a wager on two numbers that appear next to one another in the indicia 18. This wager is denoted by placing a chip on the line between the two bet options (e.g., the line between one and four or twenty-nine and thirty). A street bet (sometimes called a row bet) is a wager on three numbers on the same row. This wager is denoted by placing a chip outside the row of numbers on which the wager rides (e.g., to wager on one-two-three, the chip is placed on the line that is the outside edge of the three). A corner bet is a wager on four adjoining numbers as designated by the indicia 18. This wager is denoted by placing a chip at the four-way intersection of the four numbers (e.g., at the intersection of thirty-one, thirty-two, thirty-four, and thirty-five). A square bet is a wager on zero, one, two, or three and is denoted by placing the chip at the intersection of zero and three at the corner of a European style wheel. A five number bet is similar to the square bet, but adds the double zero. This wager is denoted by placing a chip at the intersection of zero and one, on the corner. A line bet is in essence wagering on two streets or rows. This wager is denoted by placing a chip on the outer intersection of the two rows in question (e.g., to bet on seven through twelve, a chip would be placed at the outer intersection of nine and twelve).

As a note of nomenclature, the roulette bets set forth above are sometimes divided into two categories called inside bets which include straight, split, street, corner, five, and line bets and outside bets which include red/black, odd/even, low/high, columns, and dozens.

French roulette (which uses the European style wheel 14) has a number of called bets that are honored by some gaming establishments. These bets are not typically designated by indicia 18, but may be explicitly set forth on certain tables. One called bet is the "voisins de zero" or "neighbors of zero" which covers the arc of numbers around the zero on the European wheel. Note that since wheel 14 is a U.S. style wheel, the illustrated numbers do not match up with the recited numbers herein; however, on an actual European style wheel, this arc of numbers includes twenty-two, eighteen, twenty-nine, seven, twenty-eight, twelve, thirty-five, three, twenty-six, zero, thirty-two, fifteen, nineteen, four, twenty-one, two, and twenty-five. When selected, nine chips (or a multiple thereof) are placed, two each on the intersection of zero/two/three and twenty-five/twenty-six/twenty-eight/twenty-nine and one each on four/seven, twelve/fifteen, eighteen/twenty-one, nineteen/twenty-two, and thirty-two/thirty-five. A second called bet is the "Tier du Cylindre" and covers twelve numbers with six chips (or a multiple thereof), two numbers per chip. The numbers are twenty-seven, thirteen, thirty-six, eleven, thirty, eight, twenty-three, ten, five, twenty-four, sixteen, and thirty-three. A third called bet is the "Orphelins" or "Orphans" which is a bet on the bow-tied shaped middle section of the wheel not covered by the Voisins or Tier called bets. The numbers covered are seventeen, thirty-four, six, one, twenty, fourteen, thirty-one, and nine. When selected five chips are bet. These five chips will cover the number one with one chip and the numbers six/nine, fourteen/seven, seventeen/twenty, and thirty-one/thirty-four, each with one chip. A fourth called bet is a "number and neighbor" bet which bets on the number and two neighboring numbers on each side relative to the wheel 14. It takes five chips (or a multiple thereof) to cover this wager (one for each number in the bet). A fifth called bet is a "final bet". This wager covers all numbers with the same last number (e.g., four, fourteen, twenty-four, and thirty-four). It takes four chips (or a multiple thereof) to cover this wager. Typically, only numbers one through six are eligible for final bets because numbers seven-nine only have three instances on the wheel. Another called bet is the Jeu 0, which is like the voisins de zero, but includes a smaller selection of numbers between twelve and fifteen inclusive (i.e., twelve, thirty-five, three, twenty-six, zero, thirty-two, and fifteen).

A summary of the conventional wagers and the odds are presented below in table 1.

TABLE 1

| Wager Name | Number of Numbers Covered | Odds | |
|---|---|---|---|
| Straight Up Bet | 1 | 35:1 | |
| Split Bet | 2 | 17:1 | |
| Street (row) Bet | 3 | 11:1 | |
| Corner Bet | 4 | 8:1 | |
| Square Bet | 4 (0, 1, 2, 3) | 8:1 | |
| Five Number Bet | 5 (0, 00, 1, 2, 3) | 6:1 | |
| Line Bet | 6 | 5:1 | |
| Dozens | 12 | 2:1 | |
| Columns | 12 | 2:1 | |
| Low/High | 18 | 1:1 | |
| Odd/Even | 18 | 1:1 | |
| Red/Black | 18 | 1:1 | |
| Voisins de Zero | 17 | 0, 2, 3 | 11:1 |
| | | 25, 26, 28, 29 | 8:1 |
| | | 4, 7, 12, 15, 18 | 17:1 |
| | | 19, 21, 22, 32, 35 | 17:1 |
| Jeu 0 | 7 | 0/3 | 17:1 |
| | | 12/15 | 17:1 |
| | | 26 | 35:1 |
| | | 32/35 | 17:1 |
| Tier du Cylindre | 12 | 17:1 | |
| Orphelins | 8 | 1 | 35:1 |
| | | 6, 7, 9, 14, 17 | 17:1 |
| | | 20, 31, 34 | 17:1 |
| Neighbor | 5 | 35:1 | |
| Final | 4 | 8:1 | |

As used herein, the wagers set forth in Table 1 are defined to be standard wagers. Conversely, as used herein, nonstandard wagers are those wagers, which are not standard wagers as that term is defined herein.

An interesting side effect of the nature of the table 10 is that roulette chips usually have no value denomination printed on the chip. Rather, the table 10 comes with sets of different colored chips, each usually consisting of three hundred chips of that color. When a player buys-in, the player gets her own color, and the value of an individual chip is determined by dividing the buy-in by the number of chips the player receives. For example, a player who buys one hundred chips for five hundred dollars gets one hundred chips each worth five dollars. The croupier typically places a token on top of the house stack of that color to indicate the value.

A necessary consequence of the chip scheme of a normal roulette table is that the number of players cannot exceed the number of different colors available at the table. For example, if there are only six colors, then only six players can play at that table. Electronic roulette tables which are not bound by chips allow more players to play simultaneously.

Figure 2:
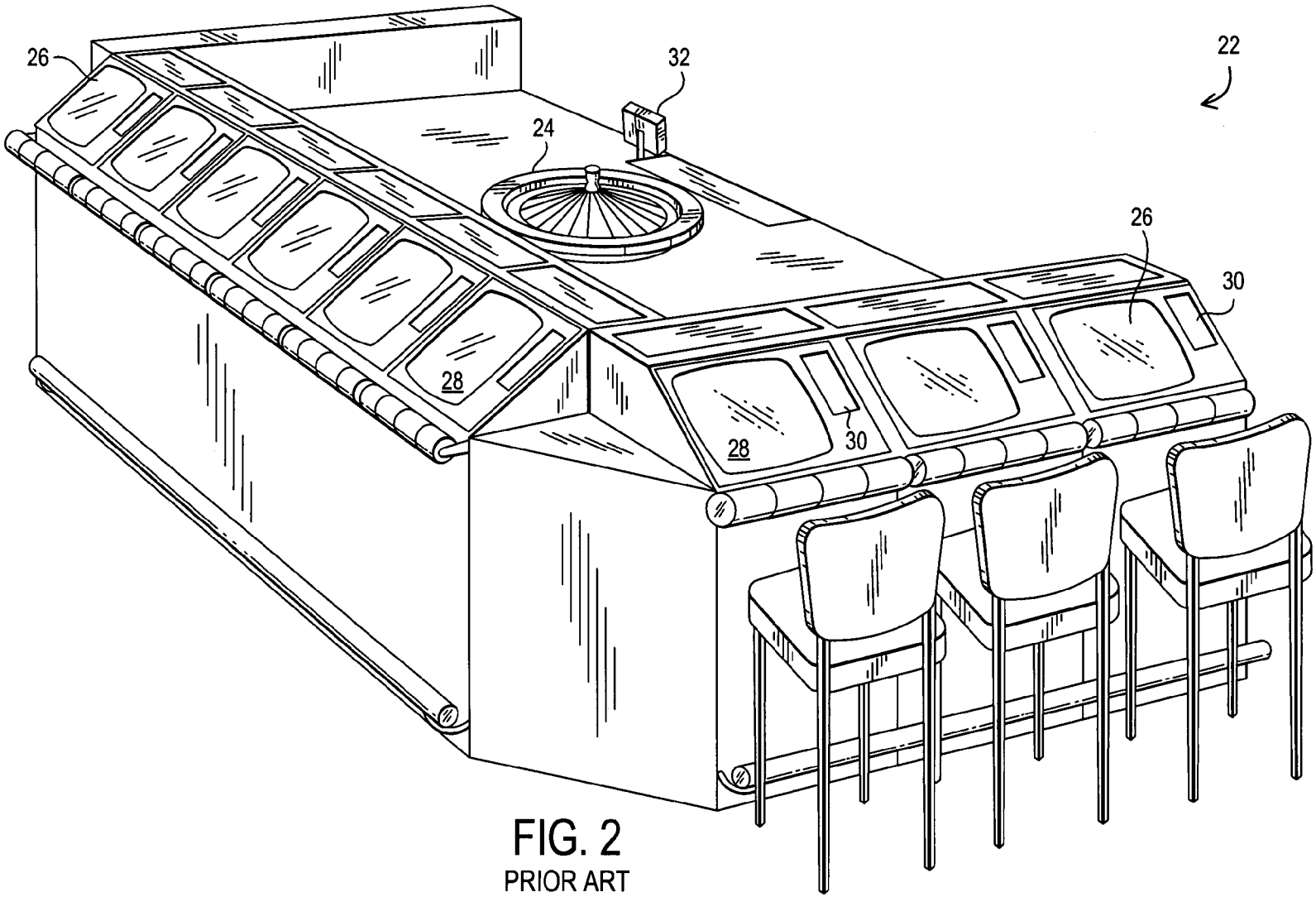
FIG. 2 PRIOR ART

A conventional electronic roulette table 22 is illustrated in FIG. 2. As illustrated, the electronic roulette table 22 includes a physical wheel 24, which may be European or U.S. style that spins freely. In place of the betting area 16, the electronic roulette table 22 includes a plurality of player terminals 26 which include a display 28 and a user interface 30. Each display 28 presents a video representation of a betting layout essentially identical to betting area 16 complete with indicia 18 and bet options 20. The display 28 may be a touch screen. Players create equity through the user interface 30, such as by inserting cash into a bill acceptor, using a cashless receipt system, or the like. Establishing equity may create a number of credits that the player may then use to place wagers. Wagers are then made by using the established equity (e.g., betting a certain number of credits) and touching the touch screen or other command functions of the user interface 30.

A croupier or other gaming establishment personnel may use a croupier screen 32 to track the wagers as they are made. For more information about an electronic roulette table 22, the interested reader is referred to U.S. Pat. No. 6,659,866 and U.S. Patent Publication No. 2006/0094493, both of which are incorporated herein by reference in their entireties.

While not specifically illustrated, a virtual roulette table is similar to the table 22, but the physical wheel is replaced with a virtual wheel whose image is provided on a display. In some implementations, the display may be remote from at least some of the player terminals. For example, the game may be running on a computer communicating with a centralized gaming server over a communications network as is well understood.

Numerous systems have been proposed to allow players to place bets across multiple balls. In some instances, the multiple balls may be introduced on a single wheel. In other instances, the multiple balls may be allocated to respective ones of a plurality of wheels. The interested reader is referred to U.S. Pat. Nos. 5,743,798 to Adams; 5,755,440 to Sher; 5,934,999 to Valdez; 6,059,659 to Busch; 6,497,409 to Matthews; 6,890,255 to Jarvis et al.; and 6,921,072 to Hughes-Watts, as well as U.S. Patent Publication Nos. 2006/0066044 to Dabosh and 2006/0178191 to Ellis and PCT Publication WO 00033269 to Lynch. The preceding patents and applications are hereby incorporated by reference in their entireties. To assist the reader in understanding such multi-ball systems, FIGS. 3 & 4 are provided.

Figure 3:
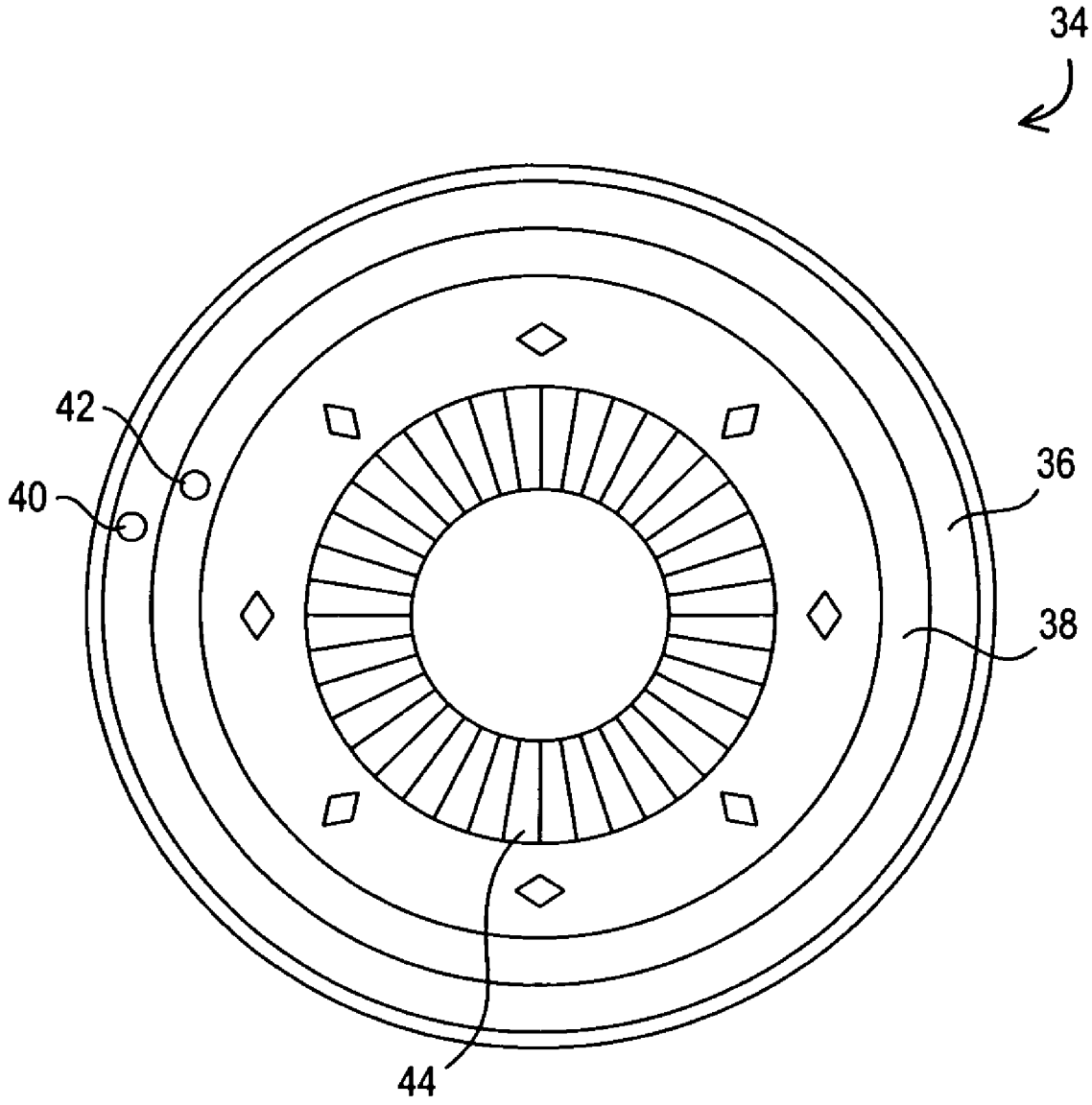
FIG. 3 PRIOR ART

FIG. 3 illustrates a single wheel, two ball roulette game from the previously incorporated Sher patent. The wheel 34 has a first track 36 and a second track 38 which support first ball 40 and second ball 42 respectively. The balls land in cups 44 as is readily understood. Again, for more detail, the interested reader is referred to the previously incorporated patent.

Figure 4:
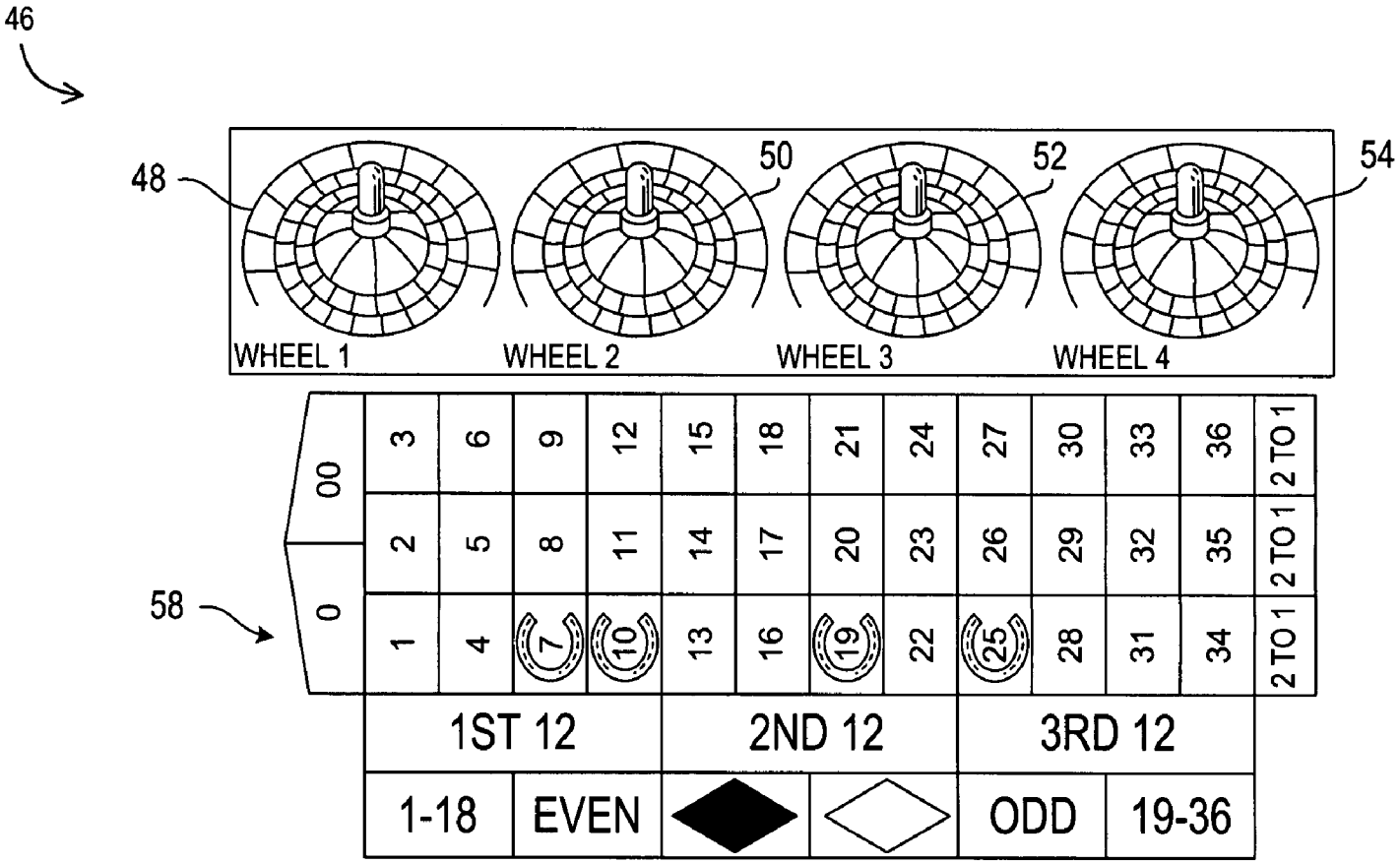
FIG. 4 PRIOR ART

FIG. 4 illustrates a multi-wheel roulette game from the previously incorporated Hughes-Watts patent. As stated in Hughes-Watts, a gaming area 46 includes four roulette wheels 48, 50, 52, 54, and 56. The four wheels are substantially conventional roulette wheels and are arranged in a row side by side. A betting area 58 is provided that allows the player to select a certain number of wheels on which the bet is to be placed.

While not illustrated herein, the Adams and Busch references disclose the concept of placing wagers on a number across a plurality of spins as part of a progressive jackpot or increased odds wager. While there is only one wheel, the plurality of spins makes this a de facto multi-wheel wager.

Given that wagering across a plurality of roulette games is documented, the present disclosure seeks to facilitate placing wagers across a plurality of roulette instances. In particular, it is contemplated that a plurality of roulette tables may be communicatively coupled to a control system. Further, the respective locations of the roulette tables may be known to the control system. As game instances are initiated the various tables, the initiation of the game instance may be reported to the control system so that the control system knows what tables are resolving and where. Further, the outcomes of each game instance may be reported to the control system. When a player makes a multi-wheel wager, the control system may select appropriate wheels, which are used to determine if the wager is a winning or losing wager.

In an exemplary embodiment, a player approaches a first table and places a wager at the first table along with an indication that the wager is to apply across a plurality of tables. The wager is passed to the control system, which then determines which wheels are used to form the basis of the wager. In a first embodiment, the control system selects wheels that are physically proximate to the first table so that the player may potentially watch each outcome as it is resolved. In a second embodiment, the control system selects wheels that are going to resolve temporally proximate to the resolution of the game instance at the first table, which may have the auxiliary result of speeding game play and increasing the "action" experienced by the player. In a third embodiment, the control system selects wheels randomly. Still other selection criteria are possible and more are discussed below. Appropriate mechanisms may be provided to audit the selection and outcome resolution so that players can be assured that they have not been cheated by having the house select the wheels. Likewise, instead of the control system determining which wheels are to be used as the basis of the wager, the control system may provide a list of eligible wheels from which the player may choose. This list may be a subset of all the wheels communicatively coupled to the control system.

In exemplary embodiments, the present disclosure is readily adapted to existing tables without having to change the nature of the game for traditional players. That is, the wheel does not have to be changed to accommodate multiple balls. The table does not have to be modified to add additional wheels. Traditional players can approach the tables and see what, on surface, looks like a traditional table. Comfortable in the knowledge that they do not have to learn a new game, they may play as they always have. If, as explained below, remote player interfaces are used (such as a mobile terminal), the concepts discussed herein may be transparent to traditional players. However, for players looking for more action or a change of pace, the features of the present disclosure are available.

To facilitate the operation of the present disclosure, the roulette game instances may be interconnected. An exemplary network 60 is illustrated in FIG. 5 showing one technique through which the roulette tables 62 may be communicatively coupled to a central server 64. The network 60 may be a network as that term is defined below in the Rules of Interpretation. Likewise, the central server 64 may be a control system as that term is defined below in the Rules of Interpretation. Each roulette table 62 may include a central processing unit (CPU) 66, which may likewise be a control system for the individual roulette table. Alternatively, the CPU 66 may be a thin client with all the primary processing performed by the central server 64. The CPU 66 may employ sensors such as magnetic sensors (not shown) to detect where the ball falls within the wheel. Likewise, a clock associated with the CPU 66 may be used with additional sensors to detect when the wheel is initially spun, its velocity, and when the wheel stops. Instead of specific sensors, cameras, such as the security cameras of the gaming establishment may likewise detect when wheels are started, when wheels are stopped, where the balls land, and other similar information.

Alternatively, a croupier input device (not shown) may be provided which allows the croupier to use buttons or keys to input information about the action at the wheel. In still another embodiment, the dealer may orally dictate information about the action at the wheel such as through the BLOODHOUND system sold by Shuffle Master, Inc. of Las Vegas Nev.

Figure 6:
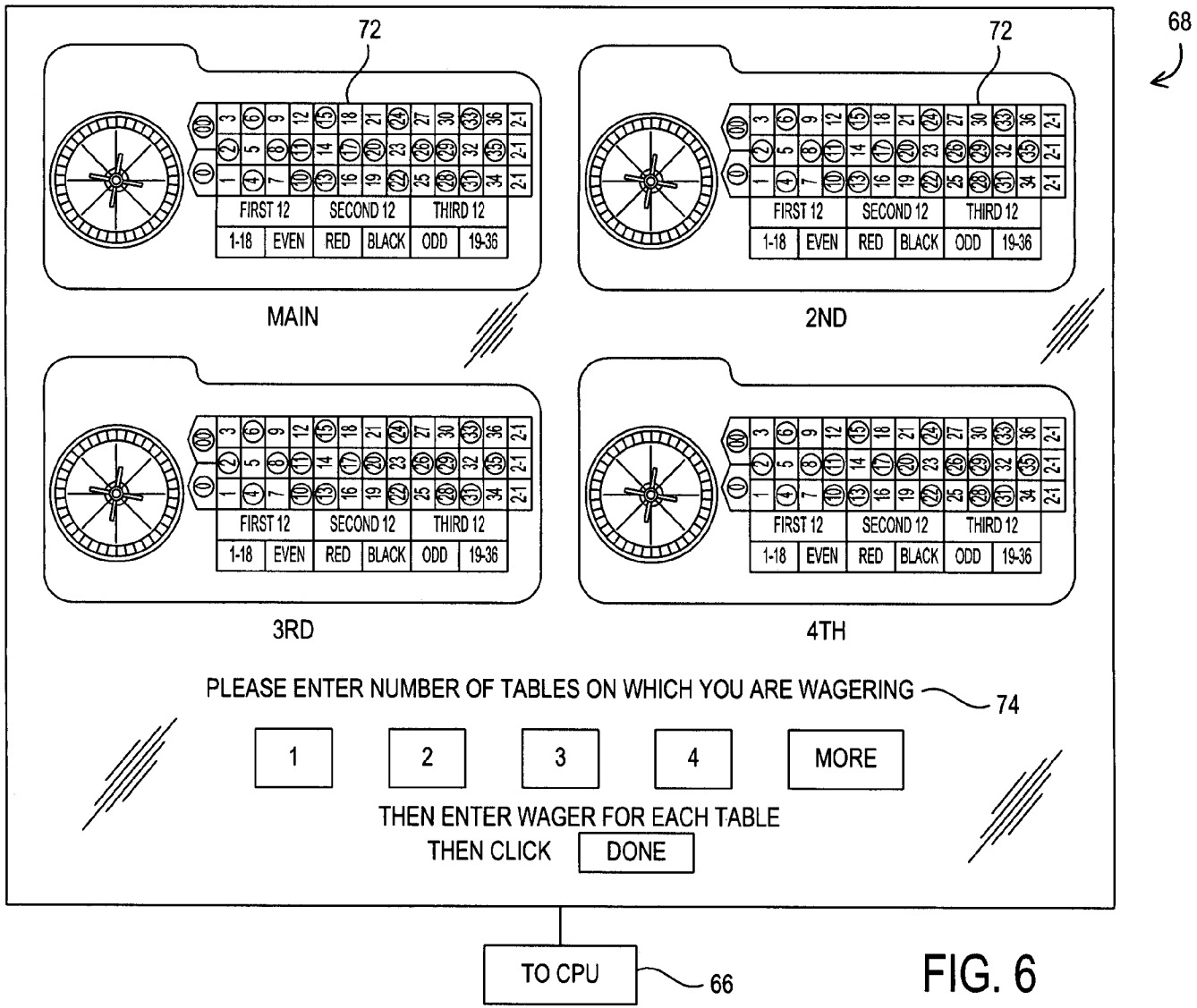
FIG. 6 illustrates an exemplary player interface.

In one embodiment, the player may place chips on the felt of the table 62 and orally indicate to the dealer what the nature of the wager is (e.g., red on the first table, black on the second table, black on the third table or thirty-four on all three tables). In another embodiment, the player may use a player interface to enter the wager. The player interface may include a display and a keypad for user input, or may be a touch screen. In either event, the player interface includes a display as that term is defined in the Rules of Interpretation set forth below. Note that a player interface may be incorporated into a player terminal on a table like table 22, may be a standalone device, may be portable, or otherwise be arranged as desired. An exemplary player interface 68 is illustrated in FIG. 6. The player interface 68 is communicatively and operatively coupled to the CPU 66 (or the central server 64 if the CPU 66 is omitted). As noted, the player interface 68 has a display 70, which may provide a graphical duplication of betting felts 72 as well as provide textual instructions 74 which query the player as to how many tables on which the player is wagering, to enter the wager for each table on the appropriate betting felt 72 and to indicate when the player is done. Other forms of instructions may be used. For example, drop down menus or the like could be used. For more information about player interfaces and customizing the user interface for ease in use, the interested reader is directed to the previously incorporated '298 application.

Figure 7:
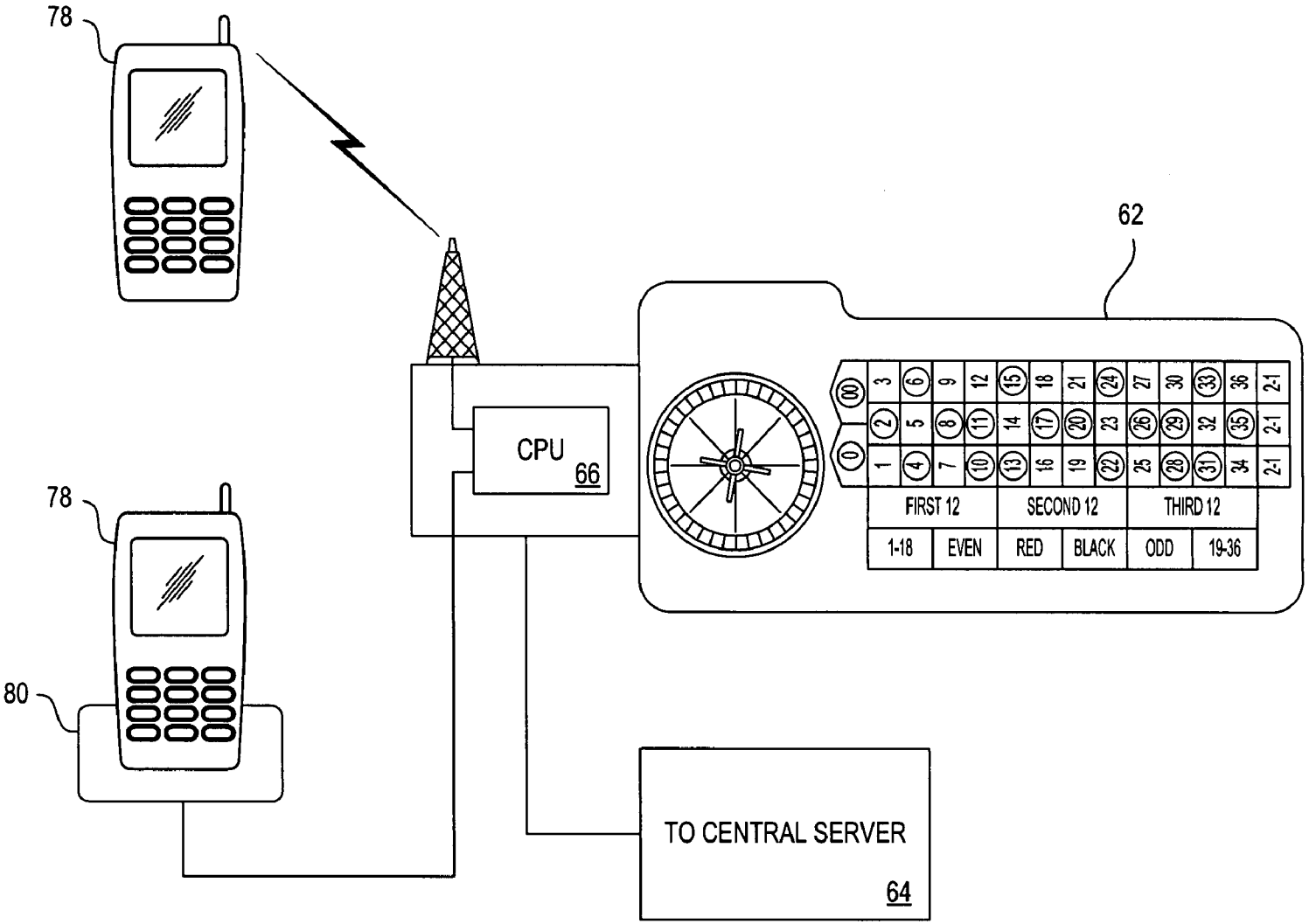
FIG. 7 illustrates an exemplary roulette system adapted to work with mobile terminals.

Note that while it is contemplated that the player interface be part of the individual tables 62, much like the player stations are part of table 22, it is also possible that the player interface may be embodied in a mobile terminal 78 that communicates wirelessly with or docks with (via docking port 80) a table 62 (see FIG. 7). While shown connecting to the central server 64 through a CPU 66 and the table 62, it is possible that the mobile terminal 78 may connect directly to the central server 64 (not shown). Still other options for the player interface are possible such as a kiosk that is removed from any particular roulette table.

In contrast to some of the previously incorporated patents and applications where the player designates which of the plurality of wheels or balls on which the player is wagering, the present disclosure contemplates that the player does not know at least one of the wheels on which the player is wagering. In some embodiments, the player may know none of the wheels on which the player is wagering. The gaming establishment may select the wheels that are used to resolve the wager. This selection process may speed up resolution of the wager relative situations where the player designates each wheel individually.

Figure 8:
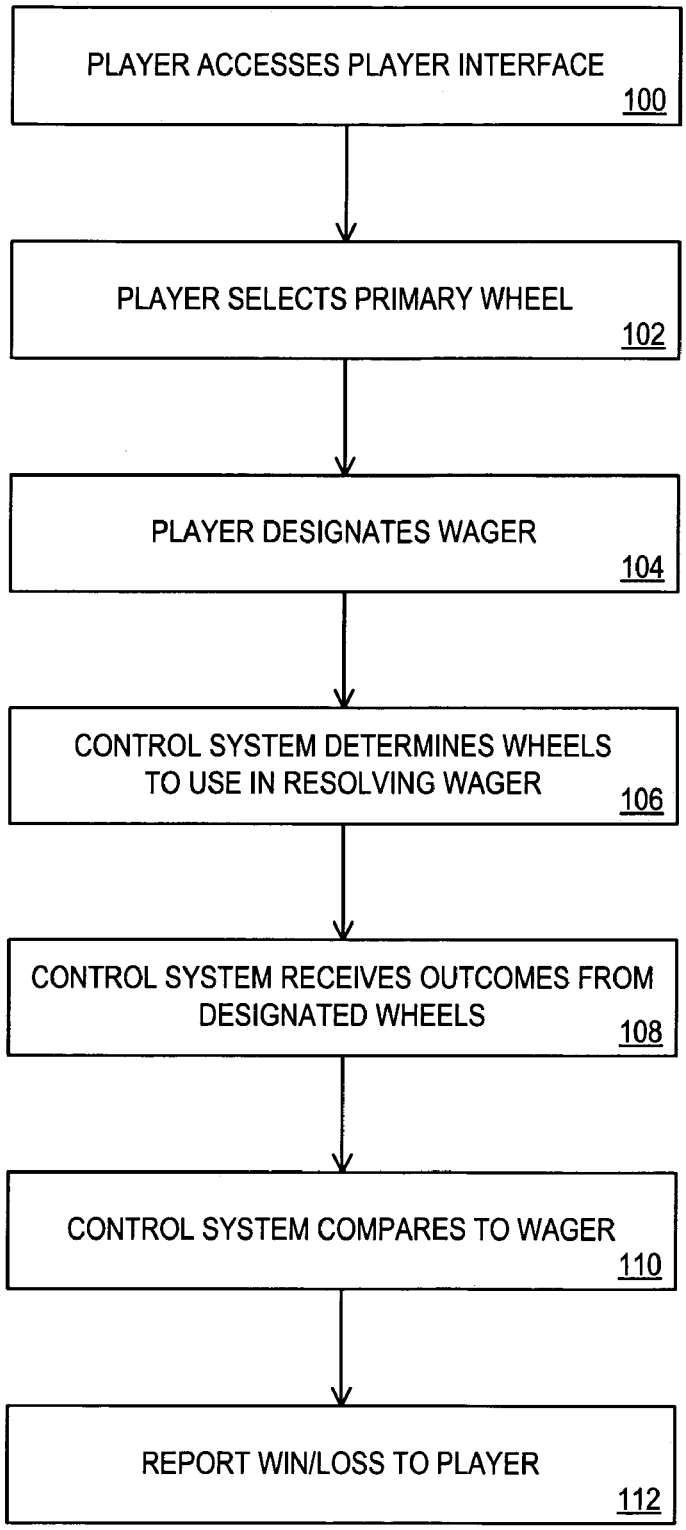
FIG. 8 illustrates a flow chart of an exemplary process of the present disclosure.

An exemplary flow chart of the process of the present disclosure is provided in FIG. 8. Initially, the player is provided betting access to the plurality of tables by accessing a player interface (block 100) or by speaking to a croupier at a table who is able to provide such access. The player selects a primary wheel on which the wager is to be placed (block 102). In some embodiments, the selection is made through the choice of player interface. For example, certain player interfaces may be associated with a particular wheel a priori, such as might be the case in a table like table 22. Alternatively kiosks may be disposed around a certain table and use of that kiosk may automatically use that certain table as the primary table. In other embodiments, the selection may be made as a function of physical proximity. In still other embodiments, the player may select through a drop down menu, graphical interface or similar mechanism which is the primary wheel for the player. For example, a player may be presented a map of roulette tables and touch the one the player desires to be the primary wheel. Once selected, the wheel may be highlighted or a marker may appear adjacent to the selected wheel. Such markers may also be used at physical tables to represent that the player has a multi-wheel wager with a particular table as the primary wheel.

The player then designates her wager (block 104). As noted above, the player may verbally tell the croupier, may place physical chips on betting indicia on the felt, or may enter the wager through the player interface. In keeping with the present disclosure, the player indicates how the wager covers the various wheels. For example, the player may wager five dollars on "Red" on the primary wheel, "Red" the second wheel and "Black" on the third wheel. Another exemplary wager could be five dollars on "34-18-34" across the three wheels in any order. Still other wagers may be made as desired. While the examples use three wheels, two or more wheels may be used for the multiple wheel wager. Note also, that a player may make multiple wagers across multiple wheels. The different wagers do not have to be tied to the same wheels.

The control system then determines which additional wheels will be used in the resolving the wager (block 106). That is, the player has designated a primary wheel for the multi-wheel wager. At least one other wheel must be selected to resolve the wager. In a first embodiment, the control system selects wheels based on physical proximity to the player. That is, the player's position may be known based on which player interface the player is using. The positions of the wheels may have been programmed into the control system a priori, so the control system may determine which wheels are closest to the player and use the closest wheels to resolve the wager. Alternatively, if the player is using a mobile terminal, the position of the mobile terminal may be tracked by virtue of what communications cell is providing the communication link to the central server 64 or multiple base stations may triangulate the position of the mobile terminal as is well understood. Even if the wireless communication is not cellular, and is based on some alternative technology, the analogies and techniques used to locate cellular phones provide helpful guidance as to how to locate the mobile terminal. Alternatively, the control system may determine which wheels are about to provide outcomes and select the next n outcomes to satisfy the wager based on n+1 outcomes (where the +1 comes from the primary wheel, and "n" represents the "n" additional wheels on which the wager is based). Other techniques to determine which wheels are used are discussed in greater detail below.

The wheels spin and produce outcomes. The wheels may be spun substantially concurrently or spread apart in time as desired.

The control system receives the outcomes from the designated wheels (block 108). Note that in some embodiments, the outcomes may be received first, and based on the receipt, the wheels may be designated. The control system compares the outcomes to the outcomes covered by the wager (block 110) and reports the win/loss to the player (block 112). The reporting may be done through the croupier orally conveying the information or presenting the information to the player through the player interface.

Where the roulette wheels are physically proximate one another, e.g., in a gambling pit, with betting terminals nearby, the player may be able to see all of the wheels and may know the win/loss before being informed through the player interface. Alternatively, the wheels may be positioned remotely from the player interface. For example, the wheels could be spread amongst a plurality of pits or even across different gaming establishments, which may or may not be commonly owned. In either case, as noted above, the player interface may provide the player information about the outcomes. This information may be in the form of video of each wheel, an animated version of each wheel, a text message, or the like as desired. Video may be gathered from security cameras, cameras especially set up to capture such video or the like as desired. It should be appreciated that the cameras and other sensors described herein may be communicatively and operatively coupled to control systems, which in turn are connected to the central server 64 or may be controlled directly by the central server 64 as desired.

In a first embodiment, the gaming establishment may define how many wheels are covered by the wager. In a second embodiment, the player may select how many wheels are covered by the wager. Likewise, the gaming establishment may limit the types of bets that are accepted to control volatility. The gaming establishment may further set odds on payouts for the multi-wheel bets. It is expected that the odds of a wager across multiple wheels are fairly long, so large payouts may be enabled. However, it is also expected that the gaming establishment may build in an appropriate house edge so that the game remains profitable for the gaming establishment.

As a matter of integrity, physical wheels may be locked out, e.g., when betting is finished on the table and the result is awaited, or when wins are being assessed and the like. When a table is locked out, the gaming apparatus will not place a player's bets on that wheel, but may still place a bet across the available wheels. For example, a player may input one bet that is repeated across all wheels, and before placing a second bet, one or more wheels may become locked out. The second bet may then be placed on the remaining wheels, so that the first bet is across all wheels, and the second bet is across a lesser number of wheels.

While more information about types of bets and wheel selection are provided below, an additional example may be helpful in understanding the ramifications of the present disclosure. A player is provided a mobile terminal and wanders around the gaming establishment. Seeing an active roulette table, the player decides to place a wager thereon through the mobile terminal. After a few rounds of this activity, a pop up window queries whether the player would like to place a multi-wheel wager. The player, curious, accepts the encouragement and requests further information about the process. An information screen appears, explaining the process of placing the multi-wheel wager along with the rules about the multi-wheel wager. The player may read the rules and proceed. The player then designates his primary wheel, which happens to be the wheel on which he has been wagering for the few rounds of activity and selects a three wheel wager. The wager is received by the control system. The control system determines when the primary wheel is to be resolved, such as by reviewing a database of anticipated wheel resolution times (see FIGS. 9A & 9B below). Based on the time of resolution of the primary wheel, the control system selects two other wheels on which the wager will be based. The control system then routes a video feed for all three wheels to the player's mobile terminal. The player may watch the primary wheel's video feed or position himself such that he can see the actual wheel spinning according to the player's tastes. In either event, the player watches the resolutions arrive. To increase the suspense, a countdown or other mechanism may be provided. Likewise, if the wager starts off successful (i.e., the player has correctly guessed the first outcome at the primary wheel), the suspense may be increased as the player waits for the other two wheels. Text or graphical encouragement may be provided to increase the suspense. After the final wheel resolves, the player is informed of his winnings, if any.

Types of Bets

There are myriad types of bets that may be enabled across the wheels. For example, two or more wheels are spun and produce two outcomes (e.g., the first wheel has a twenty-three and the second wheel has a five). These outcomes are then combined to determine the outcome of the multi-wheel game (e.g., 23-5). Note that the outcome of the multi-wheel game may thus have two or more parts. A player's bet may be required to match one or more (or all) parts of the outcome to be a winner.

The bet may be merely a multi-wheel bet, where the player does not designate what the outcome will be, but rather just wishes to bet on a multi-wheel outcome. In such an instance, the outcomes may be thought of somewhat akin to the reels on a slot machine, each contributing part of an outcome which is then compared to a paytable. For example, the outcome of three roulette wheels is 9-19-25, with each result falling into the red color category, indicating a result of red-red-red, which may offer a payout or an additional payout. Another example would be the outcomes 12-26-0, which are all Jeu 0 sectors, so the result is Jeu 0, Jeu 0, Jeu 0, which may offer a payout or an additional payout.

In another exemplary bet, the felt may have twice as many numbers (e.g., up to seventy-two), with each play using results from two wheels. The game pays for regular wins and combination wins. For example, if a player bets on twenty-one, the player wins if either wheel hits twenty-one, if both wheels add up to twenty-one, if the difference between the wheels is twenty-one (36-15), if either wheel hits a mirroring number (e.g., if the player bet one twenty-one and a wheel hits twenty (directly opposite on the wheel), or the like.

Certain numbers may only pay by way of combination (e.g., 37-72) might have better payouts. More esoterically, multiplication, division or other mathematical operators could be used between the numbers on the different wheels.

Wheel Selection

One method of selecting a roulette wheel automatically is to select the wheel based on its time of resolution (i.e., when the ball drops into a compartment and an outcome is determined). The time of resolution of a roulette wheel may be determined using a sensor to detect when the ball has settled into a compartment on the wheel and transmitting an indication of this event to the central server 64. The central server 64 may then compare the times of resolution of various roulette wheels to determine which roulette wheels are temporally closest to the primary wheel or, if there is no primary wheel designated, which are closest temporally to when the bet was made. In such an instance, the bet may be time stamped and the wheel resolutions having the closest time stamps, but after the bet's time stamp may be used.

FIGS. 9A & 9B illustrate an exemplary spin tracking database that may be stored in memory associated with the central server 64. Note that the spin tracking database is ordered based on the time of resolution of each spin, thereby simplifying the process of selecting wheels and outcomes based on the time of resolution.

In one embodiment, a roulette wheel may be selected automatically based on its time of resolution relative to another roulette wheel. For example, at the start of a gaming session, the player has designated the player's "primary wheel" as explained above. The player places his bets on the primary wheel, and then primary wheel is used as the first wheel in the multi-wheel bet. The time of resolution of the main wheel may act as a reference event for selecting subsequent wheels in the multi-wheel bet. For example, the second wheel may be selected as the next wheel to resolve after the main wheel resolves.

Exemplary database entries showing how the subsequent wheels are selected for a player are illustrated in FIGS. 10A-13. Specifically, FIG. 10A shows that Lucky Luke has wheel 2 as his primary wheel, with default bets for the second-fourth wheels. FIG. 10B shows the bet in its entirety. FIG. 11 shows what the bet was, what wheels were selected, what the outcomes were and whether the outcomes matched the bet such that Lucky Luke is a winner. FIGS. 12A and 12B mirror FIGS. 10A & 10B, but for a second player. FIG. 13 shows how that wager is not a winning wager.

In one embodiment, a second roulette wheel may be selected only if the first part of the multi-wheel bet is a match.

That is, if the player does not have a match for the primary wheel and the bet requires that all outcomes match, then there is no point in determining the other wheels since the wager is already a losing wager.

As noted above there are other ways to select the wheels, including random chance, current wheel status (e.g., a roulette wheel may be selected from the group of roulette wheels that are currently spinning and on which bets are still being accepted), anticipated resolution time (e.g., a computer program may calculate when a roulette wheel is anticipated to resolve an outcome and based on this anticipated time, the central server 64 may select the wheels which are anticipated to resolve next). Note that there is no strict requirement that the wheels resolve after the primary wheel. Rather, if the bet is entered and confirmed, then the next wheel to resolve (regardless of where it temporally lies relative to the primary wheel) may be considered the second wheel.

Another way to select the additional wheels may be based on bets placed by other players. For example, a player may place a bet that is resolved using whichever wheel has the most money bet on it for the current spin. In a second example, the player may place a bet that is resolved using whichever roulette wheel pays out the most prizes to other players on the current spin. Still another way is based on historical wins and losses. The "hottest" wheel may be selected for the additional wheel.

Listing of Available Wheels

In some instances, the player may designate which wheels will form the basis of the wager. To facilitate this designation, the player may be presented with a list of available wheels through the player interface. The same databases that are used to predict the resolution times of the wheels may be used to forecast which wheels are about to resolve and form a list that is presented to the player. Note that the list may be a subset of all the wheels communicatively coupled to the central server 64.

In another embodiment, the player may not know the wheels at the time the bet is placed, but may know the wheels before the wheels are spun or before the outcomes are determined. For example, the player may be told to place his wager on a set number of wheels without knowing which wheels are actually going to be used to resolve the wager (or the player may know only the primary wheel). Once the player has entered his wager, the control system determines which wheels are next to be resolved. The control system uses the determination to provide a list of wheels which are to form the basis of the wager to the player. The player may be given the opportunity to accept or reject the list of wheels. If the player rejects the wheels, the process may reset from the beginning or the control system may select a new set of wheels based on impending resolution time. In a variant of this embodiment, the player may have the wheels selected in this fashion by choosing an auto-select button. Thus, in much the manner that lottery numbers are quick-picked, the wheels may be "quick-picked."

Rules of Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, LDP, rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as standard definition (SDTV), enhanced definition (EDTV), high definition (HD), or the like. The information may likewise be static, in which case, painted glass may be used to form the display. Note that static information may be presented on a display capable of displaying dynamic information if desired.

The present disclosure frequently refers to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM or AMD ATHLON processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, TDMA, CDMA, GSM, EDGE, GPRS, WCDMA, AMPS, D-AMPS, IEEE 802.11 (WI-FI), IEEE 802.3, SAP, SAS™ by IGT, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

A mobile terminal is defined to be a portable computing device such as a cellular telephone, a personal digital assistant (PDA), laptop computer, handheld computer, pager, or the like. An exemplary handheld gaming device that falls within the definition of a mobile terminal is the WifiCasino GS offered by Diamond I Technologies of Baton Rouge, La. Alternate exemplary mobile terminals are those developed by Motion Computing, Inc. of Austin, Tex., such as the LS800 Tablet PC running MICROSOFT WINDOWS XP Tablet PC edition. A description of the device is available at www.motioncomputing.com/products/tablet_pc_ls.asp. Another exemplary device has been developed by Hewlett-Packard Company of Palo Alto, Calif., such as the iPAQ hw6920 running MICROSOFT WINDOWS MOBILE for Pocket PC. A description of the device is available at www.cantor-gaming.com/cgv2.html.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present disclosure, but may nevertheless be claimed in one or more continuing applications that claim the benefit of priority of the present disclosure.

What is claimed is:

1. A method comprising:

receiving a bet from a player, wherein the bet designates a certain number of outcomes across a plurality of roulette wheels, but the player does not know at least one of the roulette wheels on which the bet has been placed; and causing at least one processor to execute a plurality of instructions stored in at least one memory device to determine without player input at least one of the plurality of roulette wheels that will contribute at least one outcome for the certain number of outcomes for the bet.

2. The method of claim 1 further comprising receiving at least one roulette wheel designation from the player such that the player knows at least one roulette wheel that contributes an outcome for resolution of the bet.

3. The method of claim 1 further comprising causing the at least one processor to execute the plurality of instructions to determine a reference roulette wheel based on a designation received from the player.

4. The method of claim 1 further comprising causing the at least one processor to execute the plurality of instructions to determine a reference roulette wheel based on a position of the player within a gaming establishment.

5. The method of claim 1 further comprising causing the at least one processor to execute the plurality of instructions to determine a reference roulette wheel.

6. The method of claim 5 further comprising causing the at least one processor to execute the plurality of instructions to determine the at least one of the plurality of roulette wheels that will contribute at least one outcome based on a time of resolution of the reference roulette wheel.

7. The method of claim 5, wherein causing the at least one processor to execute the plurality of instructions to determine the at least one of the plurality of roulette wheels that will contribute at least one outcome based on physical proximities of the plurality of roulette wheels to the reference roulette wheel.

8. A method comprising:

providing betting access to a plurality of roulette tables;

receiving a wager from a player;

causing at least one processor to execute a plurality of instructions stored in at least one memory device to determine which ones of the plurality of roulette tables are to provide outcomes that determine whether the wager is a winning wager, wherein the determining is done in a manner such that the player does not know which ones of the plurality of roulette tables are to provide outcomes that determine whether the wager is a winning wager before the player places the wager;

causing the at least one processor to execute the plurality of instructions to collect outcomes from the ones of the plurality of roulette tables that provide outcomes that determine whether the wager is a winning wager; and providing a benefit to the player if the wager is a winning wager.

9. The method of claim 8 wherein at least one of the plurality of roulette tables comprises a plurality of wheels.

10. The method of claim 8 wherein providing betting access to the plurality of roulette tables comprises providing betting access to at least one physical table.

11. The method of claim 8 wherein providing betting access to the plurality of roulette tables comprises providing betting access to at least one virtual table.

12. The method of claim 8 wherein receiving the wager comprises receiving the wager through a mobile terminal.

13. The method of claim 8 wherein receiving the wager comprises receiving the wager through a user interface.

14. The method of claim 8 wherein causing the at least one processor to execute the plurality of instructions to determine which ones of the plurality of roulette tables are to provide outcomes that determine whether the wager is a winning wager comprises causing the at least one processor to execute the plurality of instructions to evaluate when each of the plurality of roulette tables will provide outcomes.

15. The method of claim 14 wherein causing the at least one processor to execute the plurality of instructions to evaluate when each of the plurality of roulette tables will provide outcomes comprises causing the at least one processor to execute the plurality of instructions to determine which roulette tables will provide outcomes closest in time to, but after, receipt of the wager.

16. The method of claim 15 wherein causing the at least one processor to execute the plurality of instructions to determine which ones of the plurality of roulette tables are to provide outcomes that determine whether the wager is a winning wager comprises causing the at least one processor to execute the plurality of instructions to choose the roulette tables that will provide outcomes closest in time to, but after, receipt of the wager.

17. The method of claim 8 further comprising receiving an indication from a player as to a primary roulette wheel which the wager will also cover.

18. The method of claim 17 wherein causing the at least one processor to execute the plurality of instructions to determine which ones of the plurality of roulette tables are to provide outcomes that determine whether the wager is a winning wager comprises causing the at least one processor to execute the plurality of instructions to evaluate when each of the plurality of roulette wheels will provide outcomes relative to outcome generation at the primary roulette wheel and causing the at least one processor to execute the plurality of instructions to select roulette tables covered by the wager based on proximity in time to the outcome generation at the primary roulette wheel.

19. The method of claim 8 wherein the at least one processor is included in a central server.

20. The method of claim 8 wherein at least a first one of the plurality of roulette tables is positioned in a first gaming establishment and at least a second one of the plurality of roulette tables is positioned in a second gaming establishment that is not the same as the first gaming establishment.

21. The method of claim 8 wherein causing the at least one processor to execute the plurality of instructions to determine which ones of the plurality of roulette tables are to provide outcomes that determine whether the wager is a winning wager comprises causing the at least one processor to execute the plurality of instructions to randomly determine which ones of the plurality of roulette tables are to provide outcomes that determine whether the wager is a winning wager.

22. The method of claim 8 wherein causing the at least one processor to execute the plurality of instructions to determine which ones of the plurality of roulette tables are to provide outcomes that determine whether the wager is a winning wager comprises causing the at least one processor to execute the plurality of instructions to determine which ones of the plurality of roulette tables are to provide outcomes that determine whether the wager is a winning wager based on an amount of money currently being wagered at each of the roulette tables.

23. The method of claim 8 wherein causing the at least one processor to execute the plurality of instructions to determine which ones of the plurality of roulette tables are to provide outcomes that determine whether the wager is a winning wager comprises causing the at least one processor to execute the plurality of instructions to determine which ones of the plurality of roulette tables are to provide outcomes that determine whether the wager is a winning wager based on information relating to historical win and loss rates at each of the roulette tables.

24. The method of claim 8 wherein causing the at least one processor to execute the plurality of instructions to determine which ones of the plurality of roulette tables are to provide outcomes that determine whether the wager is a winning wager comprises causing the at least one processor to execute the plurality of instructions to determine which ones of the plurality of roulette tables are to provide outcomes that determine whether the wager is a winning wager based on physical proximities of the plurality of roulette tables to one another.

25. A method comprising:

enabling a player to place a bet on a plurality of roulette outcomes;

identifying a reference time; and causing at least one processor to execute a plurality of instructions stored in at least one memory device to select at least two roulette wheels from a plurality of roulette wheels, wherein the at least selected two roulette wheels are the first two of the plurality of roulette wheels to resolve after the reference time and will provide at least two of the plurality of roulette outcomes for the bet.

26. The method of claim 25 wherein identifying the reference time comprises identifying when the player places the bet.

27. The method of claim 25 wherein identifying the reference time comprises identifying when an event occurs.

28. The method of claim 25 wherein identifying the reference time comprises identifying when a primary reference wheel has resolved.

29. A method comprising:

receiving a roulette based bet from a player, wherein the roulette based bet designates a certain number of outcomes across a plurality of roulette tables, but the player does not know at least one of the roulette tables on which the bet has been placed;

receiving as part of the roulette based bet from the player an indication of a reference wheel at a roulette table;

causing at least one processor to execute a plurality of instructions stored in at least one memory device to determine which of the plurality of roulette tables will resolve closest in time to resolution of the reference wheel;

causing the at least one processor to execute the plurality of instructions to use the predicted roulette tables to provide at least one of the roulette outcomes for the wager; and providing a benefit to the player if the player wins the roulette based bet.

30. A method comprising:

receiving a bet from a player;

determining a first outcome on a first roulette wheel that is a physical wheel;

causing at least one processor to execute a plurality of instructions stored in at least one memory device to determine a second outcome on a second roulette wheel that is a virtual wheel;

determining that the bet is a winner based on at least the bet, the first outcome, and the second outcome; and providing a prize to the player based on the bet being a winner.

31. The method of claim 30 wherein the bet indicates a first predicted outcome for the physical roulette wheel and a second predicted outcome for the virtual roulette wheel.

32. The method of claim 31 further comprising causing the at least one processor to execute the plurality of instructions to determine if the first predicted outcome matches the first outcome and, if so, causing the at least one processor to execute the plurality of instructions to operate with at least one display device to display an indication that the second outcome is being generated.

33. The method of claim 31 wherein the first predicted outcome is the same as the second predicted outcome.

34. The method of claim 31 wherein the first predicted outcome is different than the second predicted outcome.

35. The method of claim 30 further comprising:

causing the at least one processor to execute the plurality of instructions to determine a third outcome on a third roulette wheel that is a second virtual wheel.

36. A method comprising:

receiving a bet from a player wherein the bet relates to a first outcome at a first roulette wheel known to the player and a second outcome at a second roulette wheel unknown to the player;

causing at least one processor to execute a plurality of instructions stored in at least one memory device to determine the second roulette wheel;

determining the first outcome and the second outcome; and determining if the bet is a winning bet based on the first outcome and the second outcome.

37. The method of claim 36 wherein the roulette wheel known to the player is within viewing distance of the player.

38. The method of claim 36 wherein the roulette wheel unknown to the player is not within line of sight of the player.

39. The method of claim 36 wherein causing the at least one processor to execute the plurality of instructions to determine the second roulette wheel comprises causing the at least one processor to execute the plurality of instructions to compare physical distances between the player and a plurality of roulette wheels and causing the at least one processor to execute the plurality of instructions to select the second roulette wheel based on which roulette wheel has a shortest physical distance and is not the first roulette wheel.

40. The method of claim 36 wherein the second roulette wheel comprises a virtual roulette wheel.

41. The method of claim 36 further comprising providing the second outcome to the player electronically.

42. The method of claim 41 wherein providing the second outcome to the player electronically comprises providing the second outcome to the player through a mobile terminal.

43. The method of claim 36 further comprising providing the second outcome to the player after the player has viewed the first outcome.

44. The method of claim 36 wherein the second roulette wheel comprises a physical roulette wheel.

45. The method of claim 36, wherein causing the at least one processor to execute the plurality of instructions to determine the second roulette wheel includes causing the at least one processor to execute the plurality of instructions to determine the second roulette wheel based on a temporal resolution of a plurality of roulette wheels other than the first roulette wheel.

46. A method comprising:

causing at least one processor to execute a plurality of instructions stored in at least one memory device to operate with at least one display device to display a list of eligible roulette wheels to a player;

receiving a wager from a player, wherein the wager covers a selected plurality of roulette wheels from amongst the eligible roulette wheels;

determining outcomes at the selected plurality of roulette wheels; and informing the player of the outcomes.

47. A method comprising:

at a time when a player does not which roulette wheels will be used to resolve a multi-wheel wager, receiving, from the player the multi-wheel wager;

causing at least one processor to execute a plurality of instructions stored in at least one memory device to determine which wheels from a plurality of wheels will be used to resolve the multi-wheel wager;

providing a list of wheels that will be used to resolve the multi-wheel wager to the player; and receiving an acceptance from the player of the list before resolving the multi-wheel wager.

* * * * *

UNITED STATES PATENT AND TRADEMARK OFFICE

CERTIFICATE OF CORRECTION

PATENT NO. : 8,308,547 B2
APPLICATION NO. : 12/517661
DATED : November 13, 2012
INVENTOR(S) : Jay S. Walker et al.

It is certified that error appears in the above-identified patent and that said Letters Patent is hereby corrected as shown below:

IN THE CLAIMS

In Claim 7, Column 17, Line 32, replace “wherein” with --which includes--.
In Claim 17, Column 18, Line 24, replace the first instance of “a” with --the--.
In Claim 25, Column 19, Line 23, replace “selected” with --two-- and replace “two” with --selected--.
In Claim 25, Column 19, Line 24, replace “the first” with --a first--.
In Claim 29, Column 19, Line 44, replace the second instance of “a” with --one of the-- and replace “table” with --tables--.
In Claim 29, Column 19, Line 51, replace “predicted” with --determined--.
In Claim 37, Column 20, Line 31, between “the” and “roulette” insert --first--.
In Claim 37, Column 20, Line 33, between “the” and “roulette” insert --second--.
In Claim 46, Column 21, Line 1, replace the second instance of “a” with --the--.
In Claim 47, Column 21, Line 10, after “player” insert --,--.

Signed and Sealed this
First Day of January, 2013

David J. Kappos

David J. Kappos
*Director of the United States Patent and Trademark Office*